United States Patent [19]

Pfahl et al.

[11] 4,305,332

[45] Dec. 15, 1981

[54] TWO WEB GRAVURE DUAL IMPRESSION CYLINDER PROOFING AND SAMPLING PRESS AND METHOD

[75] Inventors: Kurt A. Pfahl, Leawood, Kans.; Stanley W. Otto, Platte City, Mo.

[73] Assignee: Hallmark Cards Incorporated, Kansas City, Mo.

[21] Appl. No.: 84,408

[22] Filed: Oct. 12, 1979

[51] Int. Cl.[3] ..... B41F 9/04; B41F 13/02; B41F 13/40

[52] U.S. Cl. ..... 101/153; 101/228; 101/247

[58] Field of Search ..... 101/152, 153, 154, 155, 101/156, 157, 176, 178, 179, 180, 181, 182, 216, 218, 219, 220, 221, 222, 223, 224, 225, 226, 227, 228, 247

[56] References Cited

U.S. PATENT DOCUMENTS

| | | | |
|---|---|---|---|
| 3,288,060 | 11/1966 | Miller | 101/219 X |
| 3,602,493 | 8/1971 | Bedinghaus | 101/177 |
| 3,613,577 | 10/1971 | Halley | 101/152 X |
| 3,712,215 | 1/1973 | Cunningham | 101/219 |

FOREIGN PATENT DOCUMENTS

| | | | |
|---|---|---|---|
| 2852605 | 6/1979 | Fed. Rep. of Germany | 101/152 |
| 485040 | 12/1917 | France | 101/228 |
| 159920 | 4/1979 | Netherlands | 101/153 |

*Primary Examiner*—J. Reed Fisher

*Attorney, Agent, or Firm*—Schmidt, Johnson, Hovey & Williams

[57] ABSTRACT

A two-web, dual purpose printing press and method is provided which can be used to "make ready" and proof gravure rollers on a first web, and to print a sample using the rollers on a second web and under substantially identical conditions during both operational modes. The press includes an interchangeable gravure roller, a pair of impression rollers, (one associated with each of the webs), and structure for selective shifting of the impression rollers between positions wherein each roller alternately forms a web-receiving and printing nip with the gravure roller. A motion-limiting stop arrangement is provided to insure that the respective impression rollers assume a substantially identical position relative to the gravure roller during the respective operational sequences of the press; in this manner printing conditions are uniform during both proofing and sampling.

6 Claims, 10 Drawing Figures

TWO WEB GRAVURE DUAL IMPRESSION CYLINDER PROOFING AND SAMPLING PRESS AND METHOD

BACKGROUND OF THE INVENTION

1. Field of the Invention

The present invention is concerned with a two-web, cylinder printing press especially adapted for make ready and proofing of gravure cylinders or rollers, and for printing of high quality samples of finished products therefrom without the necessity of employing full-scale production equipment. More particularly, it is concerned with such a press which preferably includes a pair of shiftable impression rollers disposed proximal to the gravure roller, with means for shifting of the impression rollers alternately into a web-defining relationship with the gravure roller.

2. Description of the Prior Art

During high quality gravure printing operations, it is generally necessary to "make ready" and proof individual gravure cylinders or rollers which are received from an intaglio engraver. Such proofing and make ready generally involves printing with the roller and making necessary adjustments of color strengths, color hue, half tone solid printing relationships and other parameters, until the printer is satisfied that the roller in question meets established gravure printing standards. As can be appreciated, in some instances considerable effort must be expended in these preliminary operations for a given gravure roller, particularly where exacting printing criteria for the finished product have to be met.

In full-scale production runs using gravure equipment, normally a series (e.g. four or five) gravure printing stations are placed in an in-line relationship, and a web to be printed is passed in serial order through the respective gravure stations. In full-scale production equipment of this type where extensive footages of finished product are contemplated, make ready and proofing of the respective gravure rollers does not represent a significant economic drawback. That is to say, the printer can expend whatever quantity of web is required for insuring that all of the gravure rollers are properly operating to give desired printing results, inasmuch as the extent of the final production justifies the effort and expense. Thus, in full-scale production work, gravure roller make ready and proofing is accepted as a necessary preliminary to final printing.

In many cases however, the printer wishes to prepare samples of finished product of relatively small footages, e.g., one to five thousand lineal feet of printed web. In such cases the time and expense involved in gravure roller proofing becomes, proportionately speaking, very high. As will be readily understood, the time involved in make ready and proofing for a contemplated production run of one thousand lineal feet is the same as that required for a full-scale production run of many hundreds of thousands of feet. Accordingly, there is a real reluctance on the part of printers to interrupt full production schedules for the purpose of making small samples for salesmen or the like.

In response to the above problem, it has been known to employ a single station gravure press separate from full-scale production equipment for gravure roller make ready, proofing and printing of samples. Of course, such a scheme requires that each respective gravure roller be made ready and proofed, the required amount of finished printing therefrom accomplished, and the web rewound so that the operation can be repeated until completion. However, this procedure makes it extremely difficult to predict the number of lineal feet of finished printing for each color to run in order to achieve the final desired footage. For example, if during the make ready and proofing of the first gravure roller three thousand feet of web is expended as waste, and thereafter two thousand feet of web are printed as final product, there is no way of knowing whether the second or subsequent rollers can be made ready and proofed using the three thousand feet of web previously allotted in connection with the first roller. If more than three thousand feet is expended, a portion of the "finished" printing from the first roller is destroyed because the printing from the later roller is not up to standard. Thus, it has been the practice to err on the side of liberality in printing footages from the respective gravure rollers, in order to avoid not producing enough of the sample product; of course, this represents in many cases a significant waste of material.

It has also been suggested in the past to provide a completely separate make ready unit and proofing unit for gravure rollers. Such units have presented serious technical problems, however, primarily because of the fact that the printing conditions established during the make ready proofing phase are substantially different than those encountered during actual production. To give but one example, prior make ready and proofing units may operate at relatively slow speeds (e.g., one hundred fifty lineal feet per minute), whereas actual production runs are much faster, on the order of eight hundred feet per minute. Such a disparity can and often does represent a considerable difference in printing quality between the make ready and proofing phase, and full production. Hence, prior equipment of this type has not provided a real solution to the problems outlined above.

SUMMARY OF THE INVENTION

The present invention is concerned with a two-web, dual impression cylinder proofing and sampling press which overcomes the problems heretofore encountered in connection with gravure proofing and printing of relatively short footage samples of finished product. The press of the invention preferably includes a gravure roller, and a pair of identical impression rollers shiftably mounted adjacent to the gravure roller. Structure is provided for selective shifting of the roller between alternate positions wherein each of the rollers is adjacent to the gravure roller to define therewith a web-receiving and printing nip. The shifting structure associated with the impression rollers is designed such that the rollers assume a substantially identical position relative to the gravure roller; in this manner printing conditions are maintained uniform in both the initial and sampling sequences.

The two webs for the press of the invention are preferably stored in rolls at stations on opposed ends of the press. The webs are threaded from a supply roll at each station over a series of support rollers, around the associated, shiftable impression roller, and ultimately back to a second roll forming a part of the web station.

The two impression rollers are advantageously mounted between a pair of spaced apart side plates, and the latter are pivotally supported for movement of the side plates and rollers as desired. A motion limiting stop arrangement associated with the side plates insures that the respective impression rollers assume an identical nip-forming position relative to the gravure roller in the alternate positions of the impression rollers.

In the use of the press of the invention, the make ready and proofing web and final production on sampling webs are printed in serial order using the gravure roller. In preferred forms, one of the impression rollers and the associated web are employed for make ready and proofing purposes. When this process is completed, the first impression roller is shifted away from the gravure roller and the second impression roller assumes the position vacated by the first roller. At this point the web associated with the other roller is printed, and subsequently rewound for additional registered printing. This procedure is continued by placing subsequent gravure rollers into the press and alternating between the make ready and proofing web and the finished product web as necessary to achieve the desired end sample footage.

DESCRIPTION OF THE PREFERRED EMBODIMENT

Figure 6:
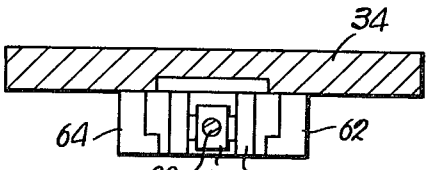
FIG. 6 is a sectional view taken along line 6—6 of FIG. 3.
Figure 5:
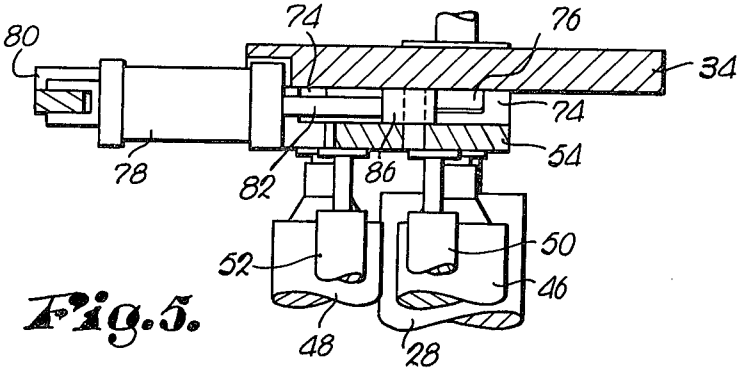
FIG. 5 is a fragmentary sectional view taken along line 5—5 of FIG. 3.
Figure 1:
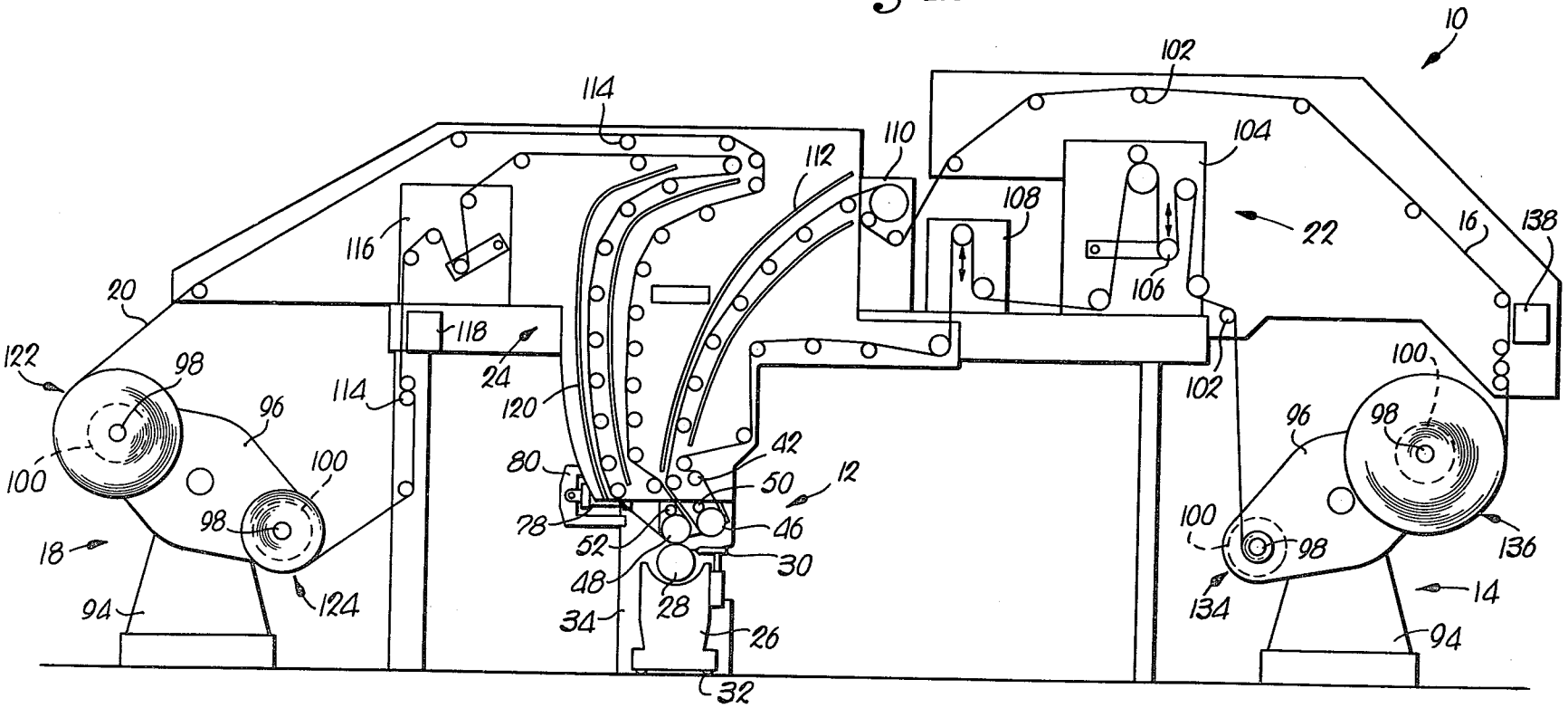
FIG. 1 is an essentially schematic side elevational view of the two-web press of the invention.

Turning now to the drawings, a press 10 in accordance with the invention is illustrated in FIG. 1. The press 10 includes a dual impression cylinder make ready, proofing and printing section 12, a right-hand web storage station 14 for the web 16 to be printed as finished product, and a web storage station 18 for a make ready and proofing web 20. Web supporting and controlling means 22 for the web 16 is interposed between the station 14 and section 12, whereas supporting and controlling means 24 for the web 20 is interposed between the station 18 and section 12.

In more detail, the section 12 includes a shiftable carriage 26 of known construction which supports an elongated, axially rotatable, engraved gravure cylinder or roller 28. The carriage 26 further supports the usual structure associated with a gravure roller, such as a roller-engaging doctor blade 30, and ink supply means (not shown). The carriage 26 is supported on wheels 32 so as to facilitate removal of the carriage from the section 12 and replacement of the gravure roller therein.

The section 12 also includes a pair of spaced, upstanding, main frame sidewalls 34, 36 which straddle the carriage 26, when the latter is operatively disposed within the section 12, and extend upwardly above the carriage a substantial distance. The walls 34, 36 merge into and are connected to the main supporting walls for the elevated portions of the press depicted to FIG. 1.

A pair of laterally spaced inner sidewalls 38, 40 are located between the main sidewalls 34, 36 and are rigidly connected to the latter. Viewing FIG. 2, it will be seen that the inner sidewalls 38, 40, terminate at a point substantially above the gravure roller 28. Moreover, the inner sidewalls 38, 40 support a series of conventional, transversely extending rotatable, web-supporting rollers 42 above the gravure roller 28. It will also be seen from FIG. 3 that a transversely extending, rigid beam 44 extends between the outermost sidewalls 34, 36 and through the inner sidewalls 38, 40. The importance of beam 44 will be made clear hereinafter.

The section 12 is provided with a pair of spaced, elongated, axially rotatable, identical impression cylinders rollers 46, 48 which are located proximal to and above the gravure roller 28. Each of the impression rollers 46, 48 is conventional and is normally provided with a rigid core surrounded by a resilient, conductive rubber blanket. Electrostatic generator cylinders 50, 52, are respectively in engagement with the impression rollers, 46, 48 in accordance with known practices.

The impression rollers 46, 48 are mounted for shifting, translatory movement thereof in unison. To this end, a pair of generally triangularly shaped side plates 54, 56 are employed which support the rollers 46, 48 for axial rotation thereof, as well as the cylinders 50, 52. The side plates 54, 56 are respectively received within the spaces between the adjacent inner and outer walls 34, 38 and 36, 40 (see FIG. 2).

Separate, vertically shiftable slides 58, 60 are likewise disposed between the sidewalls 34, 38 and 36, 40 above the corresponding side plates 54, 56. Each element is slidably disposed between spaced vertical guides 62, 64 secured to the corresponding adjacent outermost sidewall 34,36. The lowermost end of each element 58, 60 is bifurcated as at 66, and receives an upstanding tang 68, 70 extending from the upper end of the associated side plate 54, 56. A pivot pin 72 extends between and interconnects the tang of each side plate with the bifurcation of the corresponding slide element thereabove. Hence, it will be seen that the respective side plates 54, 56 are pivotal about the axis cooperatively defined by the pins 72.

Figure 4:
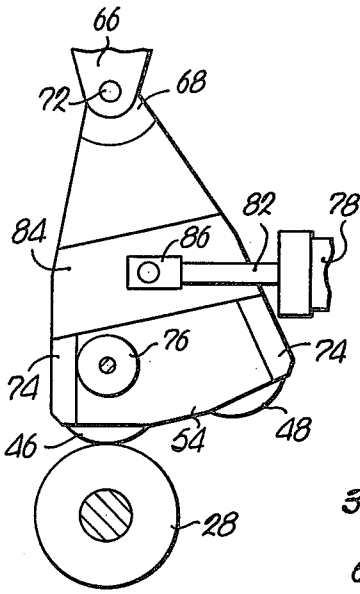
FIG. 4 is a sectional view taken along line 4—4 of FIG. 2.

The face of each side plate 54, 56 remote from the impression cylinders 46, 48 is provided with a pair of spaced, marginal, outwardly extending abuttments 74 (see FIG. 4). A fixed but rotatable stop roller 76 is secured to the inner face of each main sidewall 34, 36 at a point between the abuttments 74 on the adjacent side plate. Thus, the pivoting of the side plates 54, 56 is limited to an arc predetermined by the dimensions and locations of the stop 76 and abuttments 74.

Pivoting of the side plates 54 and 56 (and thereby the impression cylinders 46, 48) is selectively accomplished by means of a pair of piston and cylinder assembly 78 mounted on the main sidewalls 34, 36 by means of a U-shaped supports 80. Each assembly 78 includes the usual double acting hydraulic cylinder and piston, with a piston rod 82 extending outwardly therefrom. The outermost end of each rod 82 extends through a recess 84 provided in the outermost face of each corresponding adjacent side plate 54, 56, and is pivotally secured to the associated side plate by means of connection block 86.

Figure 2:
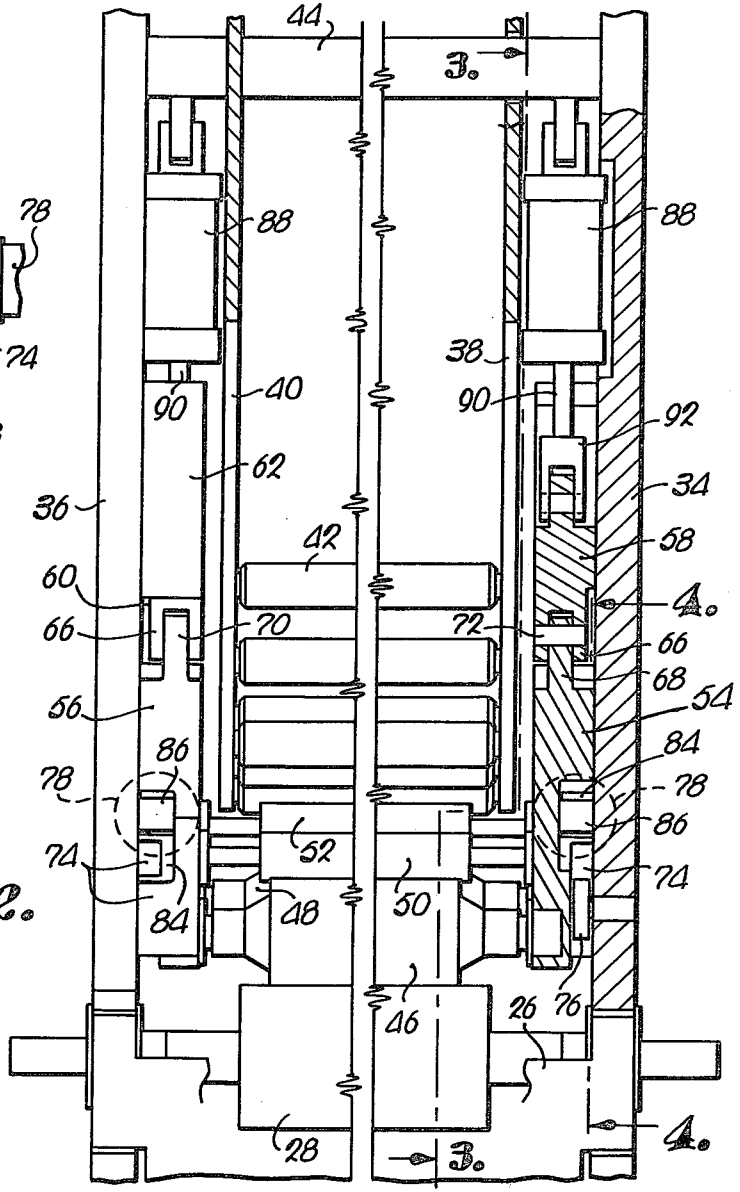
FIG. 2 is a fragmentary view in partial vertical section illustrating one end of the proofing and printing section of the press illustrated in FIG. 1.
Figure 3:
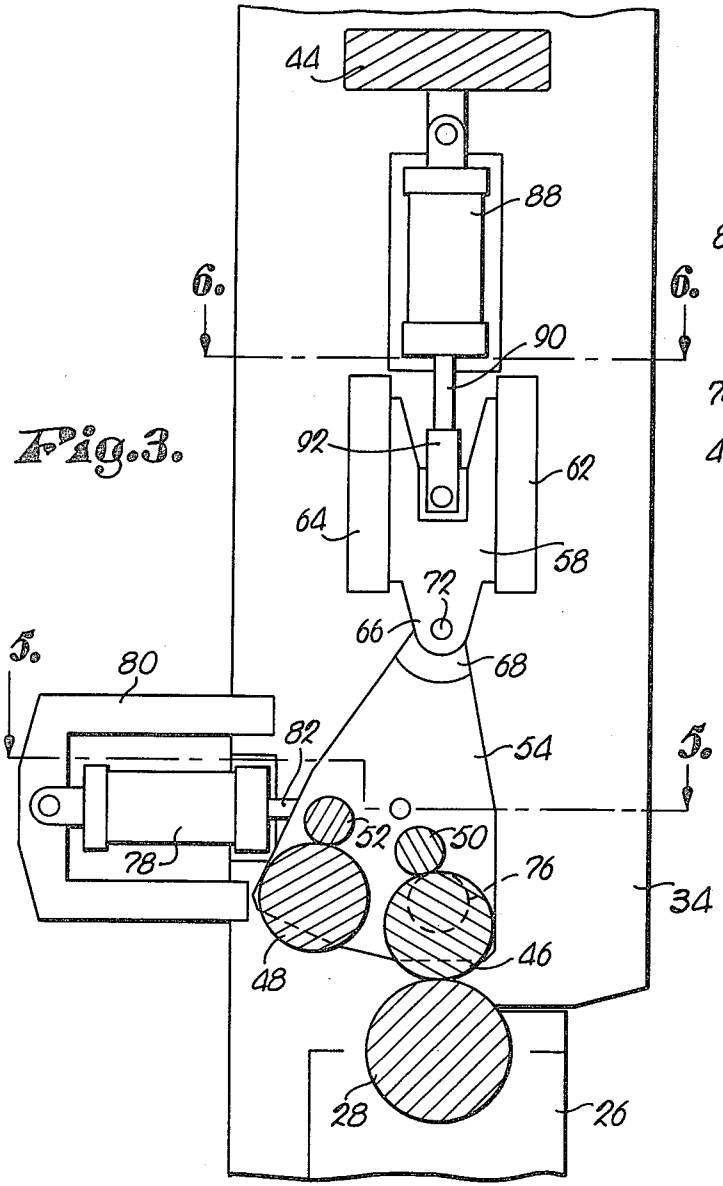
FIG. 3 is a vertical sectional view taken along irregular line 3—3 of FIG. 2 which further depicts the construction of the proofing and printing section.

A second pair of double acting piston and cylinder assemblies 88 also form a part of the section 12, and are respectively disposed above each of the elements 58, 60 in the space between the walls 34, 38 and 36, 40. As best seen in FIGS. 2 and 3, each assembly 88 is coupled to the beam 44, and has an outwardly extending piston rod 90. The outermost end of each rod 90 is in turn connected by a conventional coupler 92 to the upper end of the proximal slide element.

In the FIG. 1 embodiment the web stations 14, 18 are identical and of known construction; however, as will be apparent from the following discussion, the make-ready and proofing station 18 need not be equipped with web rewind apparatus. Each station 14, 18 as shown includes a base 94 supporting an elongated, obliquely oriented support arm 96. A pair of outwardly extending, elongated, web roll supporting winders 98 are provided adjacent the ends of each support arm 96. The winders 98 are powered by conventional means including schematically illustrated motors 100.

The web supporting and control means 22 includes, in addition to a series of elongated, spaced, transversely extending, web supporting rollers 102, a tension control apparatus 104 having a shiftable dancing roller 106; a register control device 108; a web cooling section 110; and an elongated, chute-like web dryer 112. On the other hand, the web supporting and control means 24 includes the usual web supporting rollers 114 and a tension control apparatus 116 essentially identical to the apparatus 114. A web scanner 118 and an elongated, chute-like web dryer 120 also form a part of the overall means 24. Inasmuch as the construction and operation of the elements of the web supporting and control means 22 and 24 are well known to those skilled in the art, a detailed discussion of these elements is unnecessary. Furthermore, the specific construction and operation of such elements forms no specific part of the present invention, except insofar as a brief description thereof facilitates a complete understanding of the invention.

Figure 7:
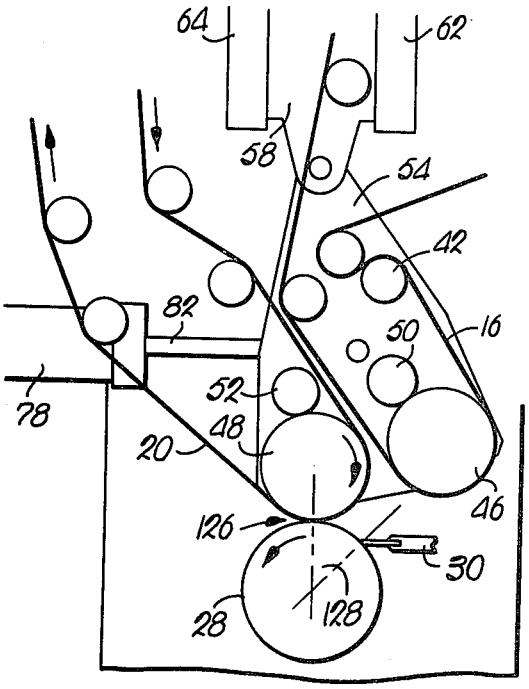

The operation of press 10 can best be understood through a consideration of FIGS. 1 and 8–10 inclusive. In the following discussion (see FIG. 1) it will be assumed that during the make ready/proofing sequence the web 20 is being continuously withdrawn from a supply roll 122 and is being taken up onto a take-up roll 124. From the supply roll the web 20 passes over the conventional support rollers 114, downwardly through the section 12 and around impression roller 48. At this point make ready and proofing printing is applied to the web (i.e. at the nip 126 defined between gravure roller 28 and impression roller 48). The web subsequently passes through dryer 120, tensioning device 116, and ultimately back to the take-up roller 124. The quality of printing obtained in this sequence can be determined through the scanner 118. This initial make ready and proofing operation is further depicted in FIG. 7 where it will be seen that the web 20 passes in essentially clockwise travel around the impression roller 48, and is printed at the nip 126 between the latter and gravure roller 28. It will also be observed that doctor blade 30 is spaced from nip 126 an arcuate distance defined by the included angle 128.

Figure 8:
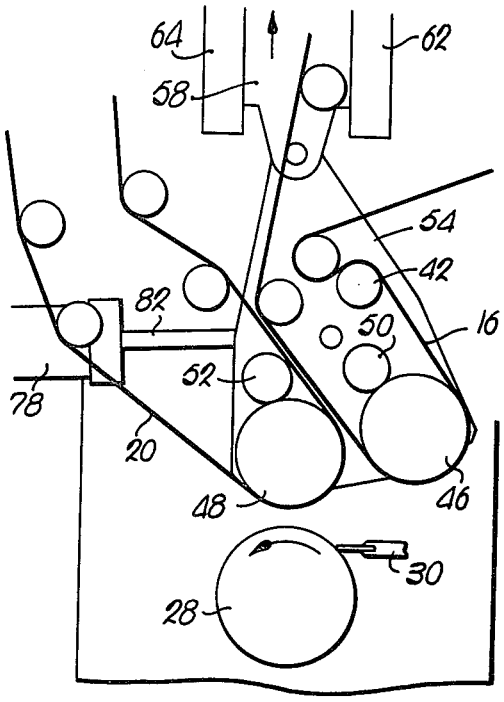
FIGS. 7–10 are respective, schematic illustrations of the make ready and proofing and printing operation of the press of the invention.
Figure 9:
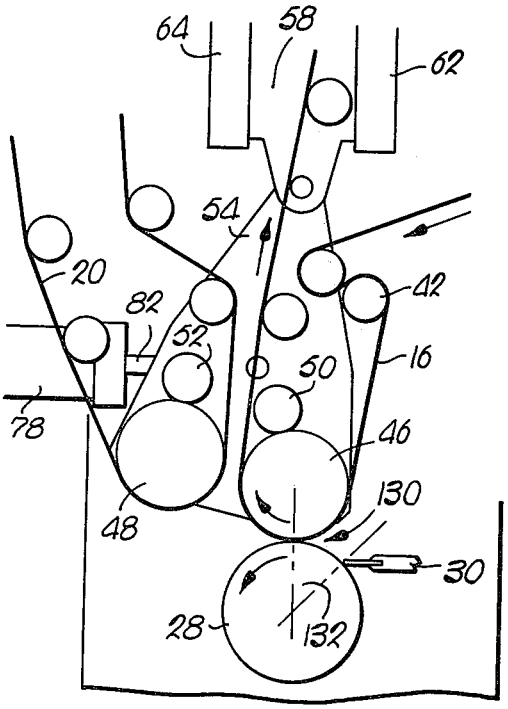

When the printer feels that cylinder 28 has been made ready and proofed sufficiently, travel of the web 20 is stopped. At this point the respective piston and cylinder assemblies 88 are actuated in order to lift the side plates 54, 56 and thereby the roller 48 away from underlying gravure roller 28. This operation is illustrated in FIG. 8. The next step involves pivoting of the side plates 54, 56, and is accomplished by actuating the piston and cylinder assemblies 78 to retract the piston rod 82 and thus pivot the side plates to the left as viewed in FIGS. 8 and 9. Following this pivoting, the assemblies 88 are again actuated to lower the plates 54, 56 such that impression cylinder 46 assumes the position originally occupied by the roller 48. This orientation is depicted in FIG. 9, where it will be observed that a nip 130 is thereby formed which is spaced from blade 30 an arcuate distance represented by the included angle 132. The angle 132 is equal to angle 128, thereby establishing that the respective rollers 46, 48 occupy the same position relative to gravure roller 28 and doctor blade 30 in the alternate positions of the impression rollers.

Referring again to FIG. 1, it will be seen that web 16 extends from a supply roll 134 over conventional support rollers 102 and serially through tension control apparatus 104 and register control device 108. The web thence passes downwardly and around the impression roller 46, upwardly through dryer 112 and web cooling section 110 and ultimately back to take-up roll 136. The web also passes a scanner 138 just prior to the take-up roll 136.

Figure 10:
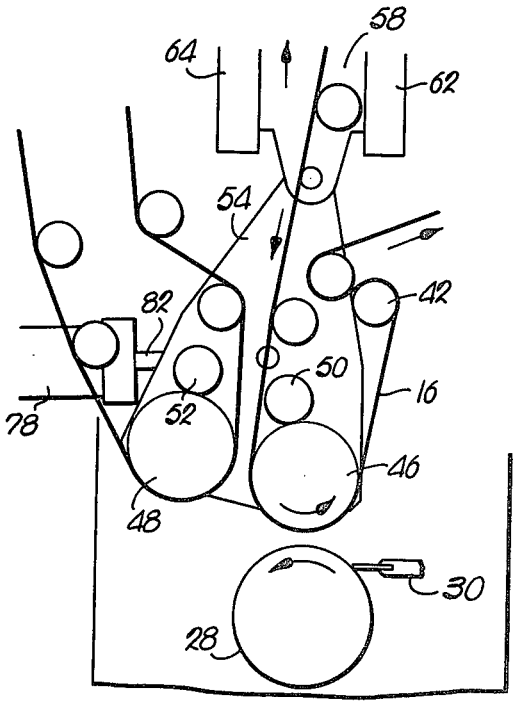

During printing operations on the finished product web 16 (see FIG. 9) the web passes from the roll 134 to the roll 136 as aforesaid and is printed at the nip 130. When the required footage of product is printed in this fashion, travel of web 16 is stopped and the assemblies 88 are employed to elevate the plates 54, 56 and thereby roller 46 away from the roller 28. At this point the travel of web 16 is resumed, but in the reverse direction, so as to rewind the web back onto the supply roll 134. This is illustrated in FIG. 10, and is for the purpose of rewinding the sample web onto the supply roll 134 for subsequent registered printing thereof using the next gravure roller.

The process described above is repeated as often as necessary to complete the desired footage of sample. That is to say, the carriage 26 is first removed from section 12 and a new gravure roller is situated therein in place of the original roller 28. The carriage is then placed back within the section 12 and make ready and proofing of the new roller proceeds in the manner discussed. Following this, the finished product web rewound onto roll 134 is reprinted using the new gravure roller; and register between the initial and subsequent printing is achieved and maintained through use of the device 108.

It will thus be seen that the invention is broadly concerned with serial order printing of separate make ready/proofing and sampling webs, particularly where printing conditions are maintained as uniformly as possible during printing of the respective webs.

In addition to sample printing, press 10 is also useful for the preliminary proofing of gravure rollers prior to use thereof on full production presses. Thus, a newly obtained cylinder can be tested under conditions closely approximating those encountered in full production runs, without the necessity of tying up the full scale equipment.

In addition, the press 10 of the invention can be used for the purpose of evaluating the characteristics of various substrates for printing, again under actual production conditions. For example, various types of paper, foil or cloth webs can be tested using the press 10, again without the necessity of disrupting full-scale production.

Having thus described the invention, what is claimed as new and desired to be secured by Letters Patent is:

1. A multiple-web makeready proofing and sampling press, comprising:

a first axially rotatable, image-bearing cylinder;

axially rotatable, makeready and sampling rollers located in proximal, side-by-side orientation;

a makeready web engaging said makeready roller;

a sampling web engaging said sampling roller;

means mounting said makeready and sampling rollers proximal to said cylinder, and for selective translatory movement of said rollers between a makeready position wherein said makeready roller is adjacent said cylinder in a nip-forming location relative to the cylinder to define therewith a makeready nip receiving said makeready web, and alternately, a sampling position wherein said makeready roller is shifted away from said cylinder and out of said nip-forming location, and said sampling roller is positioned substantially in the same nip-forming location as occupied by the makeready roller in defining said makeready nip, in order that said sampling roller and cylinder cooperatively define a sampling nip receiving said sampling web, whereby said makeready and sampling nips are alternately formed at substantially the same location relative to said cylinder;

means for selectively passing said makeready web through the makeready nip, when the makeready nip is formed, for causing said image-bearing cylinder to print upon the makeready web until satisfactory printing conditions have been established and said image-bearing cylinder is made ready;

means for selectively passing said sampling web through the sampling nip, when the sampling nip is formed, for causing said image-bearing cylinder to print upon the sampling web and produce a desired length of printed sample web; and means for rewinding said desired length of printed sample web to a position for additional printing thereon using a second image-bearing cylinder in register with the images thereon derived from the printing using the first-mentioned image-bearing cylinder, said roller moving means including structure for translatory shifting of the rollers with sufficient rapidity for ensuring that printing conditions established with said makeready roller and web are substantially uniformly maintained for printing on said sampling web.

2. The press as set forth in claim 1, said cylinder being a gravure cylinder, each of said rollers being impression rollers.

3. The press as set forth in claim 1, said roller mounting and moving means comprising:

a pair of spaced side plates rotatably supporting said makeready and sampling rollers;

means for pivoting said side plate; and apparatus for moving said rollers toward or away from said cylinder.

4. The press as set forth in claim 3, including motion-limiting means for allowing pivoting of said side plates only through a predetermined arc.

5. The press as set forth in claim 4, said motion-limiting means comprising spaced abutments extending from the faces of said side plates remote from the supported rollers, and a cooperating stop member disposed between said abutments for limiting the pivoting movement of said side plates, said roller moving apparatus including shiftable means operatively coupled to said plates for moving the plates and thereby said rollers, toward and away from the cylinder as desired when the plates are at the ends of said arc, and for exerting a desired nip forming pressure against the cylinder, said abutments and stop member being oriented for forming said makeready and sampling nips at a substantially constant angular relationship relative to the cylinder.

6. A multiple-web method of makeready, proofing and sampling comprising the steps of:

providing a makeready web in engagement with a corresponding rotatable makeready roller, and a sampling web in engagement with a corresponding rotatable sampling roller different from said makeready roller;

providing a first rotatable image-bearing cylinder, and locating said makeready and sampling rollers in proximity thereto;

making ready said first image-bearing cylinder, by— moving said makeready roller and makeready web adjacent said first cylinder to a nip-forming location relative to the first cylinder, such that the first cylinder and makeready roller cooperatively define a makeready nip, said makeready web being located in and shiftable through the makeready nip; and passing said makeready web through said makeready nip, and printing on the makeready web by engagement thereof with said first cylinder until the first cylinder is made ready with acceptable printing conditions;

sampling from said first image-bearing cylinder, by— moving said makeready roller and web away from said first cylinder, and moving said sampling roller and web adjacent said first cylinder to substantially the same nip-forming location as occupied by the makeready roller in defining said makeready nip, such that the first cylinder and sampling roller cooperatively define a sampling nip, said sampling web being located in and shiftable through the sampling nip, said makeready and sampling nips being formed at substantially the same location relative to said first cylinder;

passing a desired sample length of said sampling web through said sampling nip, and sample printing on said sample length by engagement thereof with said first cylinder.

said last-mentioned moving step being accomplished with sufficient rapidity to ensure that said made ready printing conditions on said first cylinder are substantially maintained for said sample printing on said desired length of sample web; and shifting said sampling roller and web away from said first cylinder, and rewinding said desired sample length of sampling web to a position for subsequent printing thereon with a second image-bearing cylinder and in registration with the images printed thereon using the first image-bearing cylinder; and replacing said first image-bearing cylinder with a second image-bearing cylinder;

repeating said makeready step on said second cylinder; and repeating at least the first three substeps of said sampling step using the made ready second cylinder, and printing on said sample length of sampling web in registry with the images printed thereon using the first cylinder.

* * * * *